US005143558A

United States Patent [19]

Smith

[11] Patent Number: 5,143,558

[45] Date of Patent: Sep. 1, 1992

[54] METHOD OF HEAT TREATING METAL PARTS IN AN INTEGRATED CONTINUOUS AND BATCH FURNACE SYSTEM

[75] Inventor: John W. Smith, Brighton, Mich.

[73] Assignee: Thermo Process Systems Inc., Livonia, Mich.

[21] Appl. No.: 667,464

[22] Filed: Mar. 11, 1991

[51] Int. Cl.[5] ..... C21D 9/00

[52] U.S. Cl. ..... 148/225; 266/252; 266/259; 148/206; 148/559; 148/579

[58] Field of Search ..... 148/13, 16, 16.5, 20.3; 266/259, 252

[56] References Cited

U.S. PATENT DOCUMENTS

| | | | |
|---|---|---|---|
| 3,650,853 | 3/1972 | Keough | 148/16 |
| 3,950,192 | 4/1976 | Golland et al. | 148/16.5 |
| 4,167,426 | 9/1979 | Snyder et al. | 148/16 |
| 4,205,935 | 6/1980 | Edler et al. | 266/130 |
| 4,225,121 | 9/1980 | Meyer et al. | 266/130 |
| 4,373,706 | 2/1983 | Elhaus et al. | 266/252 |
| 4,455,177 | 6/1984 | Filippov et al. | 148/16.5 |
| 4,571,273 | 2/1986 | Ebner | 148/20.3 |
| 4,596,610 | 6/1986 | Kühn | 148/16.5 |
| 4,763,880 | 8/1988 | Smith et al. | 266/259 |
| 4,836,864 | 6/1989 | Murakami et al. | 148/16.5 |

*Primary Examiner*—Upendra Roy
*Attorney, Agent, or Firm*—Fish & Richardson

[57] ABSTRACT

An integrated continuous/batch furnace system for heat treating metal parts combines a continuous furnace system and a batch furnace system. The continuous furnace system includes a preheat furnace, a rotary carburizing furnace, an equalize/diffusion furnace, an oil quench, a press quench chamber and a slow cooling chamber. The batch furnace system includes a temper furnace, a carburize/quench/slow cool furnace, and a washer. A parts tray system for holding parts to be heat treated includes a parts tray for transporting parts through the continuous furnace system, and a parts tray assembly for transporting parts through the batch furnace system. The parts tray assembly includes two parts trays detachably coupled together with rigid U-shaped alloy chips.

A method for heat treating trays of parts in an integrated continuous/batch furnace system includes determining whether to heat treat the parts with the continuous furnace system or the batch furnace system. Trays of parts to be treated by the continuous furnace system are individually loaded into the continuous furnace system. Trays of parts to be treated with the batch furnace system are connected together with clips and delivered into the batch furnace system.

A method for heat treating trays of parts in an integrated continuous/batch furnace system including treating the parts in a continuous furnace system, and washing and tempering the parts in a batch furnace system. Two parts trays are clipped together prior to washing and tempering the parts.

11 Claims, 4 Drawing Sheets

METHOD OF HEAT TREATING METAL PARTS IN AN INTEGRATED CONTINUOUS AND BATCH FURNACE SYSTEM

BACKGROUND OF THE INVENTION

This invention relates to furnace systems and methods integrating continuous and batch furnace system elements in which parts can be processed in either a continuous or a batch fashion.

Continuous heat treating systems, including carburizing furnace systems, frequently include interconnected sections or chambers for performing the various treatments employed in the heat treating process. For example, in a carburizing process, these various treatments typically include preheating, carburizing, diffusion, equalize cooling and quenching. U.S. Pat. Nos. 3,598,381 and 3,662,996, whose disclosures are incorporated herein by reference, describe apparatus having interconnected furnace stages, generally rectangular in plan view, for heating, carburizing, diffusion and equalize cooling of metal parts at selected temperatures and in different gaseous atmospheres for specified periods of time. In such systems, trays of parts are pushed or pulled by automated mechanisms one after another through each furnace in a continuous sequence, with each furnace accommodating several trays and each tray generally remaining in the same relative position in its line throughout its passage through the system. Each part receives an identical heat treatment. U.S. Pat. No. 4,763,880, whose disclosure is incorporated herein by reference,; discloses another continuous carburizing furnace system, some of whose stages are rotary furnaces which permit flexibility in the ordering of part flow through the system and in the duration of heat-processing of different parts.

Batch furnace chambers typically accommodate a single tray of parts which is manually loaded into, and later removed from, each chamber. Successive stages of batch heat treat systems are typically not interconnected and results may be somewhat less repeatable than those of continuous systems.

SUMMARY OF THE INVENTION

In general, in one aspect, this invention features an integrated continuous/batch furnace system for heat treating metal parts and which is formed by combining a continuous furnace system and a batch furnace system. A material handling automatic car transports trays of parts being heat treated to and from the continuous furnace system or the batch furnace system.

Preferred embodiments of the continuous furnace system include a preheat furnace, a rotary carburizing furnace coupled to the output of the preheat furnace, an equalize/diffusion furnace coupled to the output of the carburizing furnace, and an oil quench coupled to the output of the equalize/diffusion furnace. Other embodiments may include a rotary equalize/diffusion furnace, a press quench chamber and a slow cooling chamber.

Preferred embodiments of the batch furnace system include a temper furnace, a carburize/quench/slow cool furnace, and a washer.

In general, in another aspect, the invention features a parts tray system for holding parts to be heat treated in the integrated continuous/batch furnace system. The parts tray system includes a parts tray for transporting parts through the continuous furnace system, and a parts tray assembly for transporting parts through the batch furnace system. The parts tray assembly includes two parts trays detachably coupled together. Preferred embodiments include coupling the trays together with rigid U-shaped alloy clips which can be readily attached to, or removed from, the trays.

In general, in yet another aspect, the invention features a method for heat treating trays of parts in an integrated continuous/batch furnace system, including loading parts of a particular type to be heat treated onto a parts tray, and determining whether to heat treat the parts with the continuous furnace system or said batch furnace system. If the parts are to be treated by the continuous furnace system, then each parts tray is individually loaded into the continuous furnace system by the automatic material handling car. If the parts are to be treated with the batch furnace system, then two parts trays are connected together with clips and delivered into the batch furnace system.

In general, in still another aspect, the invention features a method for heat treating trays of parts in an integrated continuous/batch furnace system including treating the parts in a continuous furnace system, and washing and tempering the parts in a batch furnace system. Preferred embodiments of the method include clipping two of the parts trays together prior to washing and tempering the parts.

The invention thus features an integrated continuous rotary/batch furnace system having more flexibility in processing parts than either a continuous rotary or batch system alone. In particular, the batch system can accommodate "overflow" parts from the continuous system whose processing might otherwise be delayed, parts whose cycle times are so different from those of the bulk of parts being processed that they would disrupt the normal flow of parts through the continuous system, and very small quantities of parts which might be impractical to run through the continuous system.

Other advantages and features will become apparent from the following description of the preferred embodiments and from the claims.

DESCRIPTION OF THE PREFERRED EMBODIMENTS

First, the drawings are briefly described.

Figure 1:
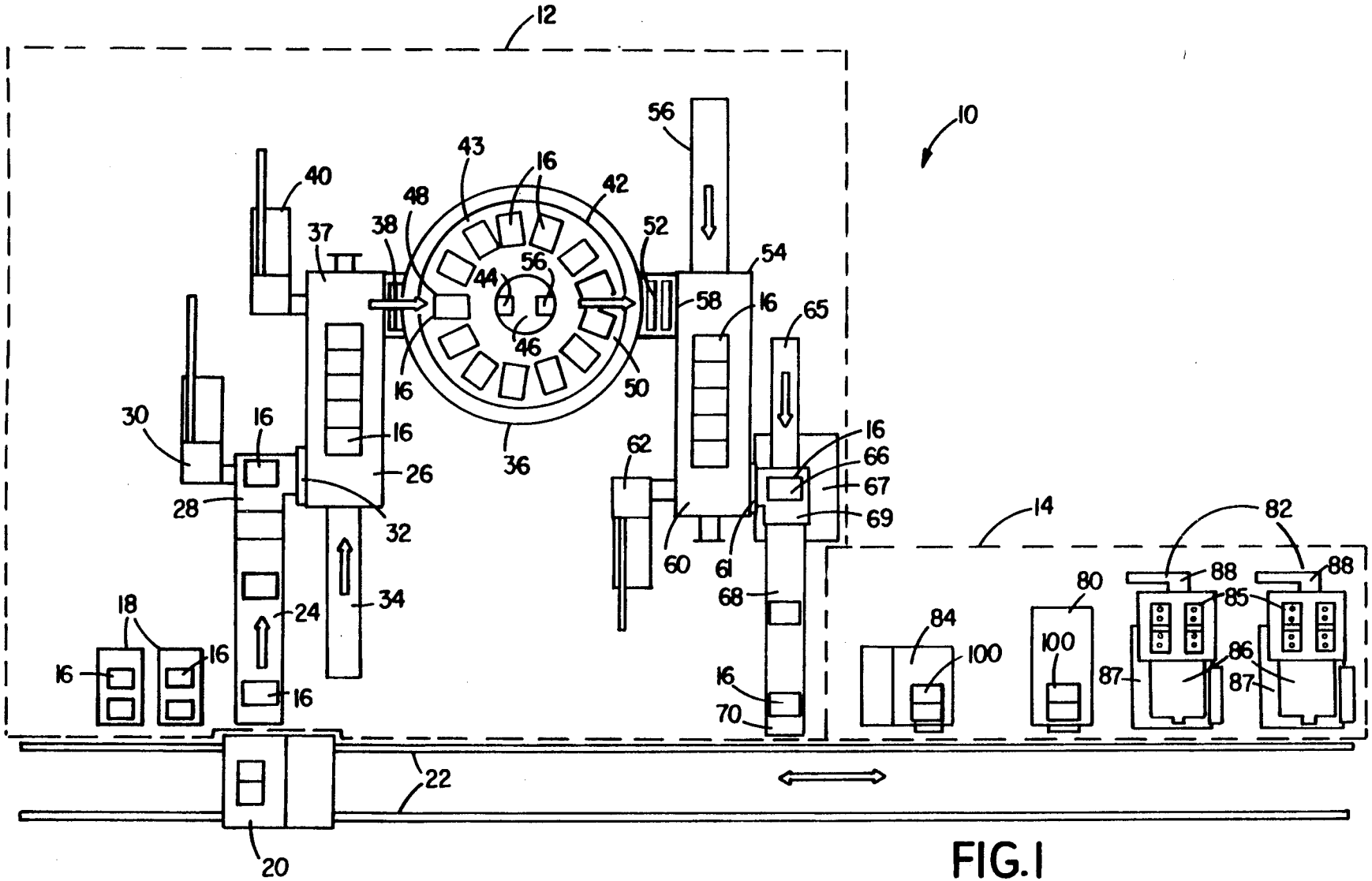
FIG. 1 is a diagrammatic plan view of a preferred embodiment of a combined rotary hearth/batch furnace system according to the invention.
Figure 4:
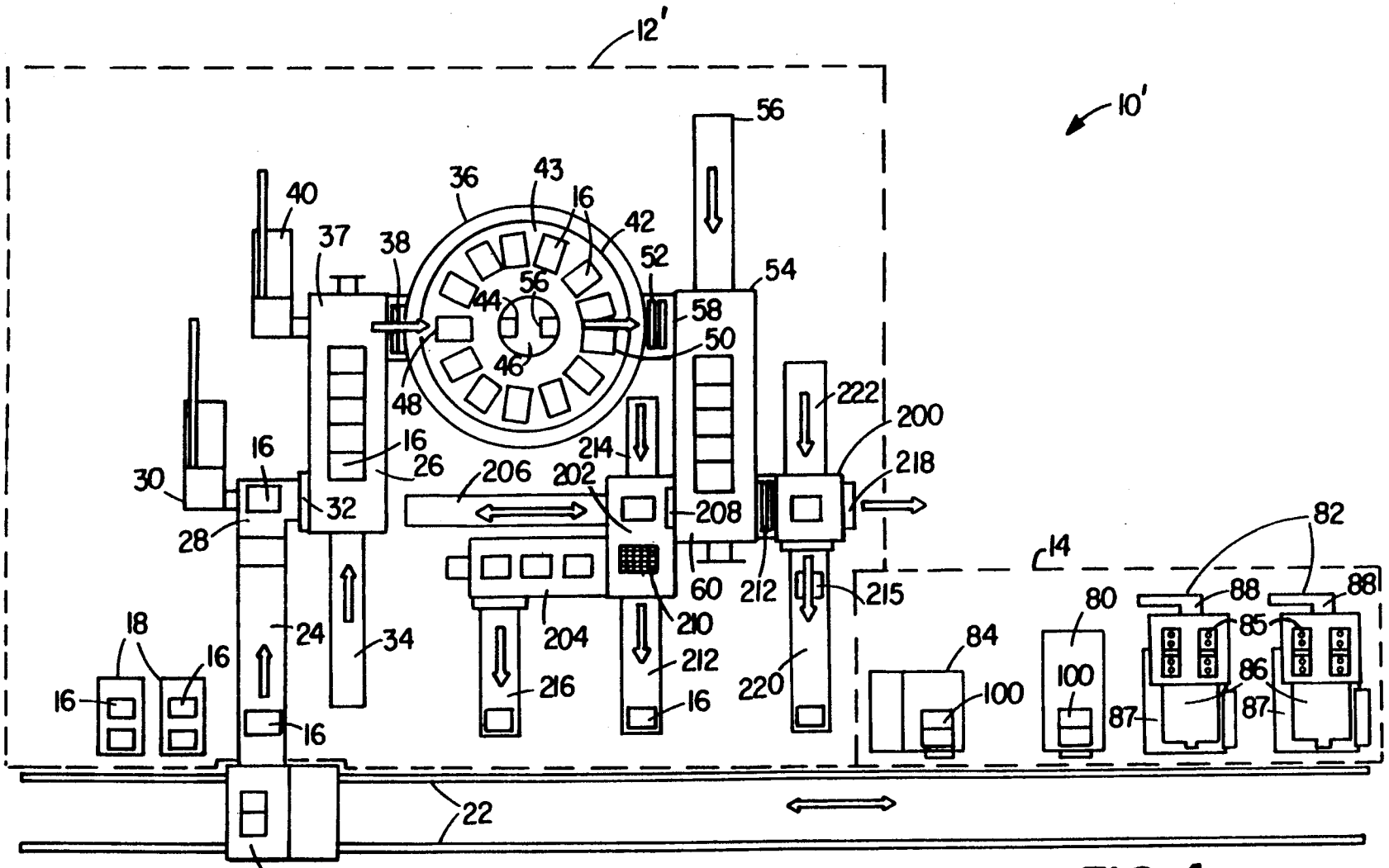
Figure 5:
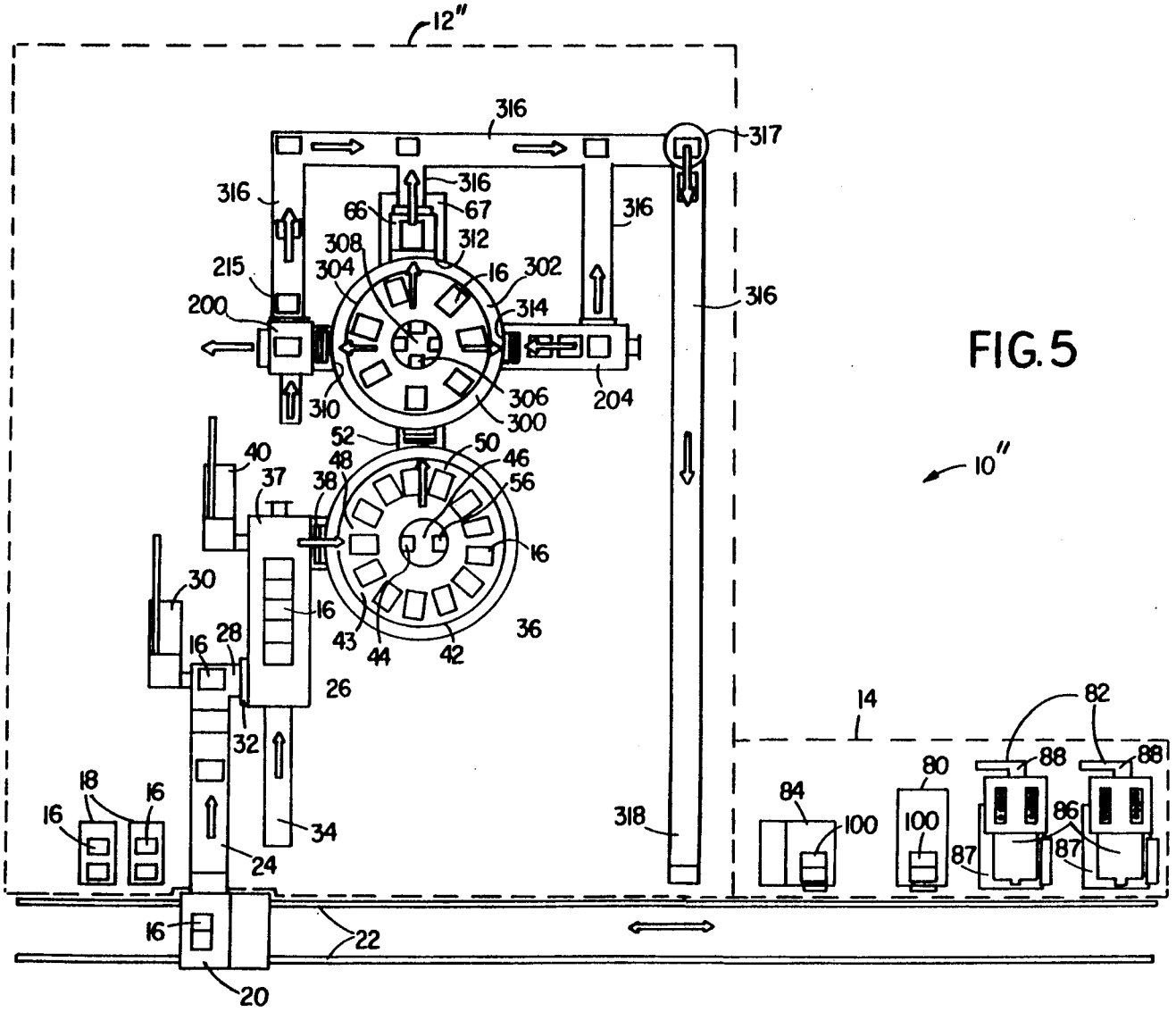

FIG. 4 is a diagrammatic plan view of another preferred embodiment of a combined rotary/batch furnace system according to the invention, featuring the furnace system of FIG. 1 with the addition of a press quench chamber and a slow cooling chamber; and FIG. 5 is a diagrammatic plan view of another preferred embodiment of a combined rotary/batch furnace system according to the invention, featuring the furnace system of FIG. 4 now including a rotary equalize/diffusion furnace, instead of a pusher type.

STRUCTURE AND OPERATION

Referring to FIG. 1, a combined rotary/batch furnace system 10 for treating metal parts integrates a continuous furnace system 12 with a batch furnace system 14. The continuous furnace system 12 includes several interconnected furnaces each forming a separate furnace chamber in which trays 16 loaded with parts are processed during a continuous carburizing cycle. (As used herein, the term "carburizing" is intended to include processes not only in carbon-rich gas atmospheres but also in carbon/nitrogen (carbonitriting) atmospheres). A suitable continuous furnace system is the ROTO-CARB TM 400 carburizing system commercially available from the Holcroft division of the assignee of this application, Thermo Process Systems Inc., Livonia, Mich. 48150. Another suitable continuous carburizing furnace system is described in the above-mentioned U.S. Pat. No. 4,763,880.

In operation of the system 10, individual trays 16 loaded with parts to be carburized, e.g., gears, shafts, and other steel parts whose surface it is desired to harden, arrive at a load/unload area 18 via a material handling automatic car 20 driven by an electric powered motor along automatic car rails 22. Automatic car 20 is positioned at each station (e.g., load/unload area 18) along car rails 22 by a locating mechanism which includes an appendage protruding from the side of the automatic car for mating with a locating wedge at each station, and a signaling device for indicating when the car is properly positioned. Trays to be sent through the continuous furnace system 12 are transferred from the automatic car 20 into the load/unload area 18 by an operator. Individual trays from load/unload area 18 are then moved by the material handling car and placed onto a conveyor 24 which transports the trays 16 in sequence to the charge vestibule 28 of a preheat furnace 26.

Preheat furnace 26 functions to heat the parts in each tray 16 to the desired carburizing temperature, typically about 1700° F., in a neutral gaseous atmosphere which prevents any carburization or decarburization. As each tray 16 arrives at the preheat furnace charge vestibule 28, a motor driven pusher 30, typically a captive chain push across type well known in the furnace arts, automatically pushes the tray from charge vestibule 28 into preheat furnace 26 through an inner charge door opening 32 in the side of the preheat furnace. Trays 16 that enter the preheat furnace through charge door opening 32 are in turn pushed the length of the preheat furnace chamber, in a single line along rails, by a motor driven, rigid type main pusher 34. The main pusher 34 is preferably constructed to push trays 16 to required tray positions along the length of the preheat furnace 26, if necessary, so that the preheat furnace can be completely emptied on shutdown without the use of empty trays. Further, during normal operation not all preheat positions of the furnace 26 typically need to be used to keep up with the remainder of the continuous carburizing furnace system.

A rotary carburizing furnace 36, having a rotatable circular donut hearth 42, is coupled to the exit end 37 of preheat furnace 26 by a special dual door structure 38, whose doors are normally closed. A donut rotary carburizing furnace is that disclosed in U.S. Pat. No. 4,763,880, and a preferred rotary donut furnace may be a 14-foot maximum diameter, shop-built standard ROTO-CARB TM 400 rotary furnace available from the Holcroft division of Thermo Process Systems Inc., of Livonia, Mich. A suitable dual door structure 38 is that described in U.S. Pat. No. 3,662,996, and illustrated in FIG. 2 thereof. As each tray 16 arrives at the exit end 37 of the preheat furnace, doors 38 are raised, and a motor driven pusher 40, typically a captive chain push across type similar to pusher 30, automatically pushes the tray onto the circular donut hearth 42 of rotary carburizing furnace 36. Proper positioning of the tray 16 on the donut hearth 42 is assured by interaction between the pusher 40 and a tray positioner 44 located within the central "donut hole" 46 of the rotary furnace 36 and communicating with its furnace chamber 42.

A controlled carbon enriched gaseous atmosphere is provided in the annular furnace chamber 43 above the rotary hearth 42 so that carbon uniformly penetrates into the surface of the parts. The atmosphere may be provided by an endothermic gas generator with carbon enrichment linked to an atmosphere analyzer/controller which may include oxygen probes. A typical carbon content for the atmosphere may, for example, be of value in the range of about 1 to 1.35% carbon by weight. An elevated temperature (e.g., 1700° F.) is maintained within the furnace chamber for carburizing.

Parts trays 16 are transported within the rotary carburizing furnace from their entry position 48, adjacent to the double door 38, to a discharge position 50, adjacent to another dual door 52, after constant rotation and positioning of the hearth 42. Hearth 42 is typically rotated continuously except when stopped to receive or discharge parts. The hearth is preferably configured to rotate in just a single direction. Since any point on the hearth may be rotated to the discharge position 50, any tray of parts 16 may be brought to the discharge position at any time regardless of how long it has remained within the carburizing furnace. This permits a mix of parts types, some of which require longer carburizing times than others, for example, to achieve the greater case depths, to be carburized simultaneously in the carburizing furnace. It also allows parts whose heat treatment is needed on a high priority basis to be preferentially discharged ahead of parts which can tolerate additional carburization and are not needed immediately.

A pusher type equalize/diffusion furnace 54 is coupled to the rotary carburizing furnace 36, adjacent to discharge position 50, by dual door 52, which is normally closed. When the carburization of a tray of parts 16 in the rotary carburizing furnace 36 is completed, hearth 42 is rotated to place the tray in the discharge position 50, dual doors 52 are raised, and a motor driven pusher 56, typically a rigid pushout type, automatically pushes the tray from hearth 42 into the charge end 58 of equalize/diffusion furnace 54.

Equalize/diffusion furnace 54 has a structure similar to that of preheat furnace 26, including a main pusher 56, similar to pusher 34, for pushing trays 16 the length of the equalize/diffusion furnace from the charge end 58 to the discharge end 60.

A conventional oil quench tank device 64 is coupled to the discharge end 60 of equalize/diffusion furnace 54 by an outlet door 61 and includes an elevator 66 which lowers parts into a tank 67, containing a quench medium such as oil, and thereafter raises them for further post quench processing. As each tray 16 arrives at the discharge end 60 of the equalize/diffusion furnace 54, outlet door 61 is raised, and a motor driven pusher 62, typically a captive chain push across type similar to pusher 30, automatically pushes the tray from equalize/diffusion furnace 54 onto elevator 66 of quench tank device 64.

The parts trays 16 are lowered on elevator 66 into quench tank 67 (i.e., dunk quenched), then raised and moved out of a quench vestibule 69 to a post quench transport line 68 by a motor driven rigid pushout 65, similar to pushers 34 and 56. Trays of parts 16 arriving at the end 70 of post quench transport line 68 are picked up by material handling automatic car 20, transported to and washed in dunk/spray washer 84 and then moved to and tempered in temper furnace 80 of batch furnace system 14. Trays are then moved by material handling automatic car 20 to the load/unload area 18. With scheduling, the individual trays can be moved temporarily to the load/unload area 18, clipped together by the operator and then processed through the batch dunk/spray washer 84 and the temper furnace 80, two at a time.

As an alternative to sending a parts tray 16 through continuous furnace system 12 for processing, parts trays 16 arriving for processing on automatic car 20 may be directed to batch furnace system 14 for processing. Batch furnace system 14 includes one or more GPC batch temper furnaces 80, one or more GPC carburize/-quench/slow cool furnaces 82, and the GPWSD dunk/-spray washer 84, all commercially available from the Holcroft division of the assignee of this application, Thermo Process Systems Inc., Livonia, Mich. 48150. In general, the batch furnace system 14 differs from the continuous furnace system 12 in that parts trays must be loaded into and subsequently removed from each batch system component, rather than flowing through the system components as in the continuous system. Further, the furnace atmospheres within the batch system components tend to be more stagnant that the furnace atmospheres of the continuous system components, which have more circulation.

Carburize/quench/slow cool furnace 82 has a furnace chamber 85 located at the rear of the furnace, and a slow cooling chamber 86 and an oil quench 87 located in front of furnace chamber 85. Cooling chamber 86 is located above oil quench 87 and has provisions for vertically stacking several levels of trays. An elevator is provided for lowering trays into oil quench 87. Trays are moved into and out of carburize/quench/slow cool furnace 82 by a rear pusher/puller handler 88 located behind furnace chamber 85. Alternatively, an extended reach handler on automatic car 20 may be used in place of handler 88.

The batch furnace system 14 performs carburizing, quenching, and cooling operations in sequence as programmed in carburize/quench/slow cool furnaces 82, then washing in dunk/spray washer 84, and tempering in temper furnace 80. A typical multi-segment cycle for the carburize/quench/slow cool furnace 82 is (1) preheat parts in furnace chamber 85; (2) carburize parts in furnace chamber 85; (3) slow cool parts in cooling chamber 86; (4) reheat parts in furnace chamber 85; (5) quench parts in oil quench 87; and (6) discharge/drain parts.

One alternative cycle is (1) preheat parts in furnace chamber 85; (2) carburize parts in furnace chamber 85; (3) quench parts in oil quench 87; and (4) discharge/-drain parts. Another alternative cycle is (1) preheat parts in furnace chamber 85; (2) carburize parts in furnace chamber 85; (3) slow cool parts in cooling chamber 86; and (4) discharge/drain parts.

Figure 2:
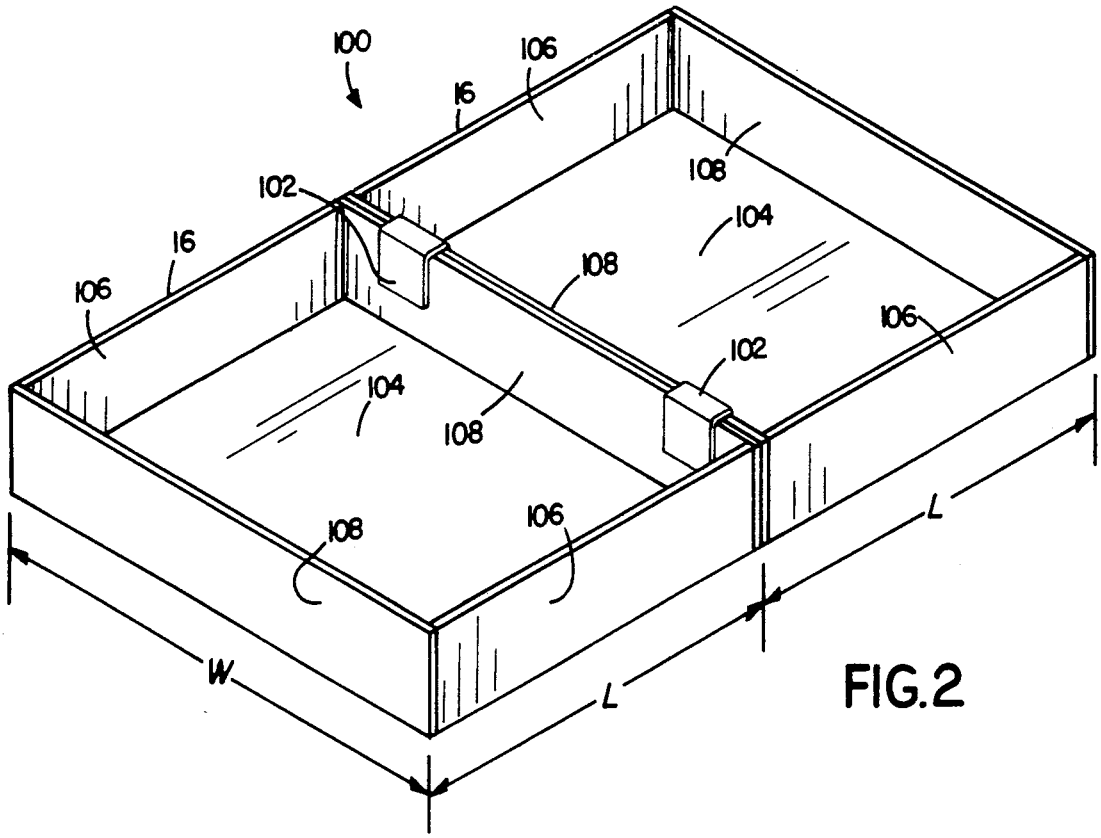
FIG. 2 is a perspective view of a two-piece parts tray system for use with the combined rotary hearth/batch furnace system of FIG. 1.
Figure 3:
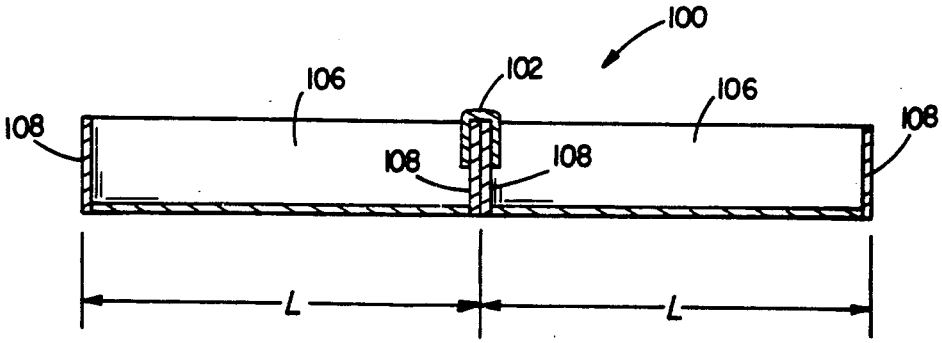
FIG. 3 is a side view (at smaller scale) of the two-piece parts tray system of FIG. 2.

Referring to FIGS. 2 and 3, a two-piece parts tray 100 for holding parts to be processed by batch furnace system 14 is furnished by clipping together two parts trays 16 otherwise used for holding parts to be processed by continuous furnace system 12 (FIG. 1). Each parts tray 16 has a grid surface 104, a pair of side ribs 106 traversing the length "L" of the tray, and a pair of side ribs 108 traversing the width "W" of the tray. A pair of inverted U-shaped alloy (e.g., nickel-chrome) clips 102 couple the parts trays 16 to each other along aligned and adjacent side ribs 108 to form a two-piece parts tray 100.

Typically, the continuous furnace system 12 by itself is designed to operate using two sizes of parts trays 16, a square 24"×24" tray, where L=W=24", and a rectangular 18"×24" tray, where L=18" and W=24". Either size tray is designed to carry a maximum 400 lb. gross load. The standard size chambers of the continuous furnace system will hold more of the 18"×24" trays than the 24"×24" trays.

Although a ROTO-CARB TM 400 line by itself can be operated with either size tray, only the 18"×24" tray can be used effectively with the standardized 24"×36" batch type line. With a 14'- 0" maximum diameter rotary hearth furnace chamber (maximum diameter set by the practical limits of transporting this shop-built furnace on "over-the-road" carriers), it is not economical or practical to use a continuous furnace tray larger than 24"×24". The use of an 18"×24" tray increases the number of available tray positions in the fixed 14'-0" diameter rotary hearth furnace which further increases its flexibility (i.e. more trays of different type parts).

The GPC batch furnace system 14 typically operates with a standard 24"×36" tray, consisting of two 18"×24" pieces permanently bolted together, as by tack-welded bolts, having a 1200 lb. gross load capacity. The two-piece 24"×6" GPC size parts tray 100 is formed by clipping together two 18"×24" trays 16 with clips 102. The resulting configuration has a capacity of 800 lb. rather than 1200 lb. typical of GPC trays.

Referring to FIG. 4, an alternative embodiment of a combined rotary/batch furnace system 10' for treating metal parts integrates a continuous furnace system 12' with the batch furnace system 14 of FIG. 1. The continuous furnace system 12' includes the same elements as that of the continuous furnace system 12 of FIG. 1, except a conventional press quench chamber 200, an oil quench tank 202, and a cooling chamber 204 are coupled to the discharge end 60 of equalize/diffusion furnace 54, replacing the oil quench tank 67 only of FIG. 1. A bidirectional motor driven pusher/puller 206, typically a rigid rod type mechanism, directs a tray 16, arriving at the discharge end 60 of equalize/diffusion furnace 54, either through an outlet door 208 to an intermediate position and then directly onto an elevator 210 (similar to elevator 66 of oil quench 64) of oil quench tank 202, or through an outlet door 212 into press quench chamber 200.

Part trays 16 directed first to an intermediate position and then directly to the oil quench elevator 210 may be lowered by the elevator into the oil quench tank 202, then raised and moved out to the post quench transport line 212 by a motor driven rigid pusher 214. Alternatively, parts trays 16 directed to the oil quench elevator 210 may bypass the oil quench tank 202, and instead be moved across elevator 210 directly into cooling chamber 204. Parts trays so directed, move through cooling chamber 204 and are pulled from the cooling chamber out onto post cooling transport line 216.

Parts trays 16 directed to press quench chamber 200 may be removed through a sealing slot-type door 218 for manual press quenching. Press quenched parts are manually reloaded onto trays at reloaded position 215. Parts trays containing the manually reloaded press quenched parts are then transported away from the reload position 215 along post press quench transport line 220. Empty trays are moved from the press quench chamber to the reload position 215 by a motor driven rigid pusher 222.

Parts trays emerging from the ends of transport lines 212, 216 and 220 are picked up by material handling automatic car 20, transported to and washed in dunk/-spray washer 84, and then moved to and tempered in temper furnace 80 of batch furnace system 14. Trays are then moved by material handling automatic car 20 to the load/unload area 18. With scheduling, the individual trays can be moved temporarily to the load/unload area 18, clipped together by the operator and then processed through the batch dunk/spray washer 84 and the temper furnace 80, two at a time.

Referring to FIG. 5, another alternative embodiment of a combined rotary/batch furnace system 10'' for treating metal parts integrates a continuous furnace system 12'' with the batch furnace system 14 of FIG. 1. The continuous furnace system 12'' includes the same elements as that of the continuous furnace system 12 of FIG. 1, except a rotary equalize/diffusion furnace 300 replaces the equalize/diffusion furnace 54 of FIG. 1, and a press quench chamber 200 and a cooling chamber 204 are now coupled directly to the rotary equalize/diffusion furnace 300.

Rotary equalize/diffusion furnace 300 is similar in size (diameter) to rotary carburizing furnace 36, but has fewer tray positions on its rotary hearth 304 than that of the carburizing furnace. Tray parts are spaced further apart in this chamber so that slow cooled trays reintroduced into the chamber 302 will have no cooling effect on adjacent, hot trays. This reduced number of trays is possible since the residence time for a tray 16 in the rotary equalize/diffusion furnace 300 is substantially shorter than that for the carburizing furnace, and thus fewer tray positions are required to process the same number of parts.

Rotary equalize/diffusion furnace 300 is coupled to the carburizing furnace 36, adjacent to the discharge position 50, by dual door 52, which is normally closed. When the carburization of a tray of parts 16 in the rotary carburizing furnace 36 is completed, hearth 42 is rotated to place the tray in the discharge position 50, dual doors 52 are raised, and a motor driven pusher 56, typically a captive chain type pusher, automatically pushes the tray from hearth 42 onto the circular hearth 304 of rotary equalize/diffusion furnace 300. Proper positioning of the tray on the hearth 304 is assured by interaction between the pusher 56 and a tray positioner 306 located within the central "donut hole" 308 of the rotary furnace 300.

Equalize/diffusion furnace 300, like carburizing furnace 36, permits parts requiring different diffusion times to be processed together at the same time in the equalize/diffusion furnace chamber 302 since hearth 304 can move a parts tray 16 to a discharge position upon demand. Equalize/diffusion furnace 300 includes three outlets 310, 312, and 314, coupled to press quench chamber 200, oil quench 67, and cooling chamber 204, respectively, to permit alternative quench and cooling treatments to be utilized on a parts tray 16 as required. Parts trays 16 are transported within the rotary equalize/diffusion furnace 300 from their entry position adjacent to the dual door 52, to one of the discharge positions 310, 312 or 314 after rotation of the hearth 304. Hearth 304 is typically rotated continuously except when stopped to receive or discharge parts. Since any point on the hearth may be rotated to any of the discharge positions, any tray of parts 16 may be brought to any discharge position at any time regardless of how long it has remained within the equalize/diffusion furnace. This permits a mix of parts types, some of which require longer diffusion times than others, to occupy the equalize/diffusion furnace simultaneously. It also allows parts whose heat treatment is needed on a high priority basis to be preferentially discharged ahead of parts which can tolerate additional time within the equalize/diffusion furnace and are not needed immediately.

Parts trays 16 discharged from the rotary equalize/-diffusion furnace 300 through outlet 310 enter press quench chamber 200 for press quench processing, and are subsequently transported from the press quench chamber to the post processing tray return line 316. Parts trays 16 discharge from the equalize/diffusion furnace through outlet 312 enter oil quench 67, and are also transported from the oil quench to the post processing tray return line 316. Parts trays 16 discharged from the equalize/diffusion furnace through outlet 314 enter cooling chamber 204, and are transported from the cooling chamber along post processing tray return line 316. Trays that are discharged from the oil quench tank to tray return line 316 will be rotated 90° by a corner turntable 317 to maintain proper tray orientation.

Parts trays 16 arriving at the end 318 of post processing tray return line 316 are picked up by material handling automatic car 20, transported to and washed in dunk/spray washer 84, and then moved to and tempered in temper furnace 80 of batch furnace system 14. Trays are then moved by material handling automatic car 20 to the load/unload area 18. With scheduling, the individual trays can be moved temporarily to the load-/unload area, clipped together by the operator and then processed through the batch dunk/spray washer 84 and the temper furnace 80, two at a time.

The operator at the load table of the integrated continuous/batch furnace system 10 of FIG. 1 (or 10' of FIG. 4, or 10'' of FIG. 5) determines parts tray loading and tray configuration based on available parts and the heat treating cycle required to be run. Both the continuous furnace system 12 (or 12', or 12'') and the batch furnace system 14 are capable of running the same heat, carburize, diffuse, slow cool, reheat, and dunk quench cycles.

If large quantities of a part are accumulated at one time for the same cycle, the operator can decide to clip two of the 18''×24'' continuous furnace trays 16 together to form a two-piece tray 100, and direct the two-piece tray to the batch furnace system 14 by way of the automatic car 20. Although the batch furnace system is physically capable of handling a single 18''×24'' tray 16, it does so inefficiently. The smaller single tray would also end up offset within the batch furnace chambers, sometimes toward the front and sometimes toward the rear of the chamber, depending on the particular batch chamber.

If only small loads of a similar part are available at one time, the operator can decide to run single 18''×24'' trays of the part through the continuous furnace system.

If a load of parts requires any atypical cycles (i.e., extra long or extra short), the operator can decide to direct the trays of parts to the batch furnace system rather than to the continuous furnace system where the atypical cycles would possibly disrupt the flow of other parts through the continuous furnace system and reduce furnace utilization (efficiency) and/or cause scheduling problems. Thus, the utilization of the entire continuous/batch furnace system may be optimized by the operator judiciously directing the trays of parts to either the continuous furnace or the batch furnace portion of the integrated furnace system.

Other embodiments are within the scope of the following claims.

I claim:

1. A method for heat treating trays of metal parts in a combination continuous and batch furnace system, comprising the steps of loading parts of a particular type to be heat treated into at least one parts tray;

determining whether to heat treat said parts of said particular type with said continuous furnace system or said batch furnace system;

individually loading each said tray containing said parts into said continuous furnace system in response to a determination to heat treat said parts with said continuous furnace system; and coupling a plurality of said trays containing said parts of said particular type and loading said coupled trays into said batch furnace system in response to a determination to heat treat said parts with said batch furnace system.

2. The method of claim 1 wherein said coupling step comprises clipping two of said trays together end-to-end.

3. The method of claim 2 wherein said coupling step comprises placing said trays end-to-end and positioning at least two U-shaped metallic alloy clips over the adjacent end walls to clip the trays together.

4. A method for heat treating trays of metal parts in a combination continuous and batch furnace system, comprising the steps of loading parts to be treated into at least one parts tray;

determining whether to heat treat said parts in a continuous furnace system or a batch furnace system;

loading at least some of said parts trays containing said parts into said continuous furnace system;

heat treating said parts in each said parts tray in said continuous furnace system;

discharging each said parts tray from said continuous furnace system;

loading other parts trays, not loaded into said continuous furnace system, into said batch furnace system;

heat treating said other parts in said batch furnace system;

discharging said other parts trays from a heat treating portion of said batch furnace system;

transporting said discharged parts trays from said continuous furnace system to said batch furnace system;

washing said parts in each said parts tray in a dunk/-spray washer of said batch furnace system; and tempering said parts in each said parts tray in a temper furnace of said batch furnace system.

5. The method of claim 4 wherein said heat treating in said continuous furnace system comprises the steps of preheating said parts in each said parts tray in a preheat furnace;

carburizing said parts in each said parts tray in a rotary hearth carburizing furnace; and treating said parts in each said parts tray in an equalize/diffusion furnace.

6. The method of claim 4 wherein said transporting step comprises moving said parts trays from said continuous furnace system with an automatic car.

7. The method of claim 4 further comprising the step of coupling a plurality of said parts trays discharged from said continuous furnace system prior to said washing and tempering steps.

8. The method of claim 5 further comprising the step of cooling said parts in each said parts tray in a cooling chamber.

9. The method of claim 5 further comprising the step of quenching said parts in each said parts tray in an oil quench.

10. The method of claim 5 further comprising the step of press quenching said parts in each said parts tray in a press quench.

11. The method of claim 7 wherein said coupling step comprises clipping two said parts trays together end-to-end.

* * * * *